US006757930B2

(12) United States Patent
Kajgana

(10) Patent No.: US 6,757,930 B2
(45) Date of Patent: Jul. 6, 2004

(54) ICE SCRAPER WITH BRUSH AND THE GLOVE

(76) Inventor: Zarko Kajgana, 9781 Springhouse Ln. E., Concord, OH (US) 44060

( * ) Notice: Subject to any disclaimer, the term of this patent is extended or adjusted under 35 U.S.C. 154(b) by 263 days.

(21) Appl. No.: 10/051,779

(22) Filed: Jan. 17, 2002

(65) Prior Publication Data

US 2003/0131430 A1 Jul. 17, 2003

(51) Int. Cl.[7] ..... A47L 13/12; A41D 13/08
(52) U.S. Cl. ..... 15/111; 15/227; 15/236.02
(58) Field of Search ..... 15/227, 111, 236.02

(56) References Cited

U.S. PATENT DOCUMENTS 4,683,592 A * 8/1987 Strongwater
4,748,711 A * 6/1988 Markus
4,870,712 A * 10/1989 Markus
5,369,257 A * 11/1994 Gibbon
5,729,857 A * 3/1998 Martin
6,125,493 A * 10/2000 Daw

* cited by examiner

*Primary Examiner*—Randall E. Chin

(57) ABSTRACT

An ice scraper with brush and the glove, which has an anatomically designed handle grip. The ice scraper and the brush are mounted into the glove to protect the user's hand from snow, ice, water, and cold. The ice scraper blade and the brush are inserted into a fork branched handle, which is designed with a comfortable and firm grip to maximize the scraping force when applied to an ice covered windshield of a car. Glove is made out of waterproof fabric and internally can be insulated with any thermo-insulating fabric. The glove is provided with Velcro fasteners that are placed at the end of the glove. This prevents entering of the snow and ice into the glove.

5 Claims, 12 Drawing Sheets

DETAIL - "Y"

DETAIL - "X"

VIEW - "A"

DETAIL - "Y"

DETAIL - "X"

VIEW - "B"

DETAIL - "Y"

DETAIL - "X"

VIEW - "C"

DETAIL - "Y"

DETAIL - "X"

VIEW - "D"

DETAIL - "Y"

DETAIL - "X"

VIEW - "E"

DETAIL - "Y"

DETAIL - "X"

VIEW - "F"

ICE SCRAPER WITH BRUSH AND THE GLOVE

BACKGROUND OF THE INVENTION

This invention relates to an ice scraper and brush with the glove for removing ice and snow from a windshield of the car, and is an improvement over the conventional ice scrapers. One of the more common scrapers have an ice scraper and the brush, which does not protect user's hand and their garment/sleeve from snow, ice, water and similar. Because of the lack of a sturdy grip on the conventional ice scrapers it is also hard to remove thick sheets of ice from the windshields. For example in U.S. Pat. No. 4,922,569 to Brinker, patent does not disclose any gloves attached to the ice scraping tool. In addition U.S. Pat. No. 378,322 to Young shows extendible ice scraper and snow brush but also without any glove attached to the ice scraping tool. His invention also lacks the ability to act sturdy on the frozen surfaces.

Finally, object of the present invention, ice scraper and brush with the Glove, is to provide a ridged support to the user's hand that will allow him/her to use the ice scraping tool with ease by having an extra support of an anatomically designed handle grip, which may be either in the form of a gun barrel like, spherically shaped or T-shaped handle grip. This invention is also designed to protect users garment and hands from the snow, ice, water and cold. Other objective is to provide an easily fabricated and inexpensive product. The above mentioned objects will become more apparent when the following drawings and descriptions are read.

SUMMARY OF THE INVENTION

The ice scraper and brush with the glove includes three different anatomically designed handles. These include gun barrel like handle, spherically shaped handle, and the T-shaped handle. Another important feature of the invention is the waterproof glove that has an extended sleeve. Further, glove also comprises velcro fasteners that are located on the sleeve portion of the glove. In addition brush as well as the fork branched extension of the ice scraper and brush with the glove is provided with a gusset.

DETAILED DESCRIPTION OF THE PREFERRED EMBODIMENTS

Figure 1:
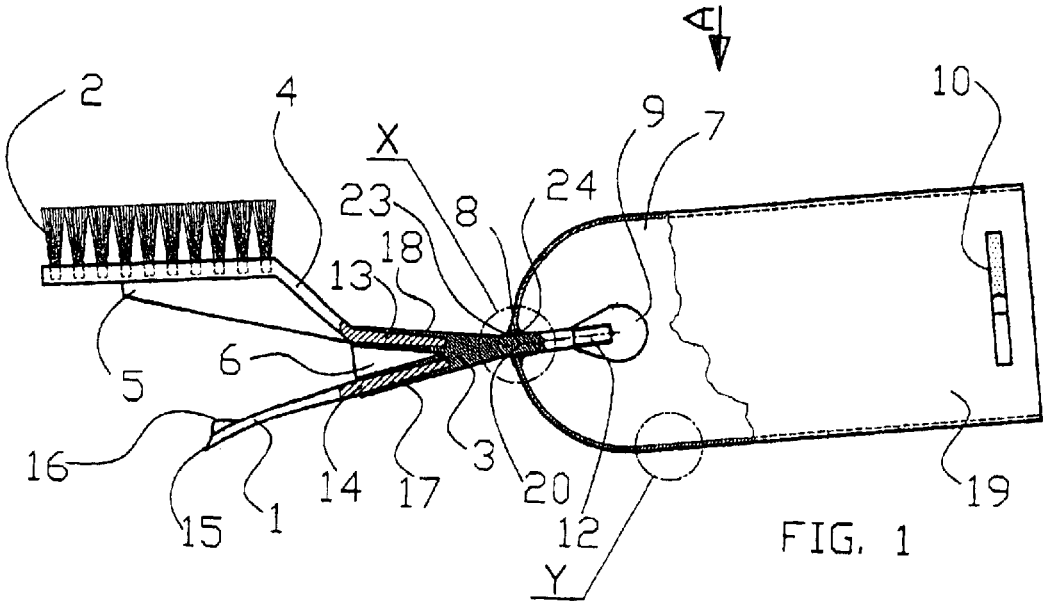
FIG. 1 shows plane view of the ice scraper and brush with the glove and the spherically shaped handle.

FIG. 1 illustrates an ice scraper blade 1 having a conical portion of the body 14 installed into the fork branched handle 17. Blade 1 has a beveled edge 15 with the elevated ridges 16, which support in the breaking of the ice. Brush 2 has a conical portion of body 13, installed into a fork branched handle 18. Extension of the brush handle 4 is supported with a gusset 5. Branched body 3 is reinforced with gusset 6. Handle neck 20 and slit on the top of the glove 7 are sealed with a plated member 24 located inside the glove. Treaded portion of the Handle 12, is connected to the anatomically shaped spherical grip 9. Glove 7 is extended with the sleeve 19, and is provided with velcro fasteners 10. This prevents entering of the snow into the glove. Outside surface of the glove 21 that is made out of waterproof material, protects inside of the glove 22 that can made out of any thermo-insulating fabric. Illustrated inside of the glove 22 can be made out of any thermo-insulating fabric.

Figure 2:
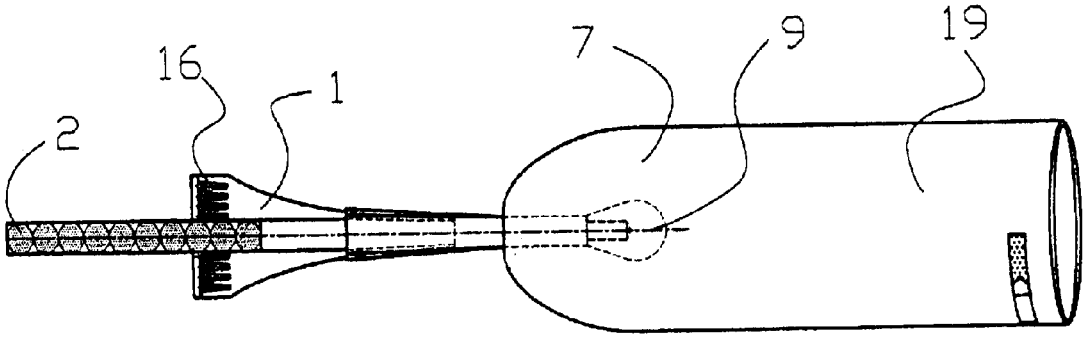
FIG. 2 is a top view of the ice scarper and brush with the glove of FIG. 1.

FIG. 2 shows top view "A" of the ice scraper and brush with the glove with elevated ridges 16, which supports the beveled edge 15 in breaking of ice. FIG. 2 also indicates location of the brush with the respect to the glove and the ice scraper.

Figure 3:
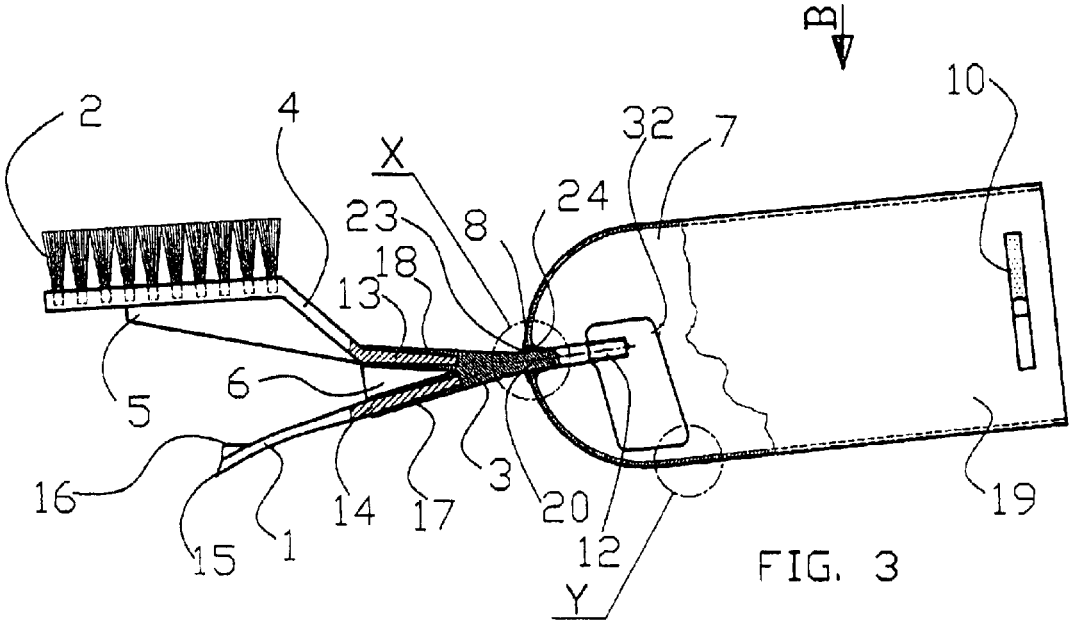
FIG. 3 is a plan view of the ice scraper and brush with the glove and the gun barrel like handle.
Figure 3A:
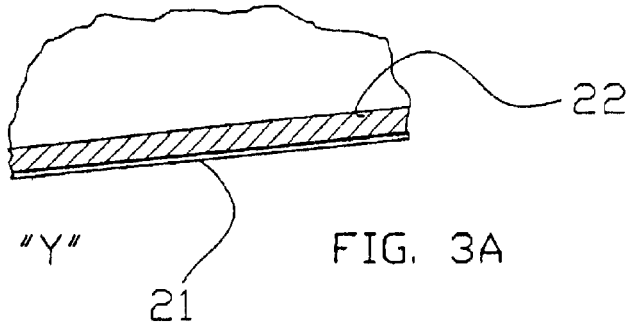
Figure 3B:
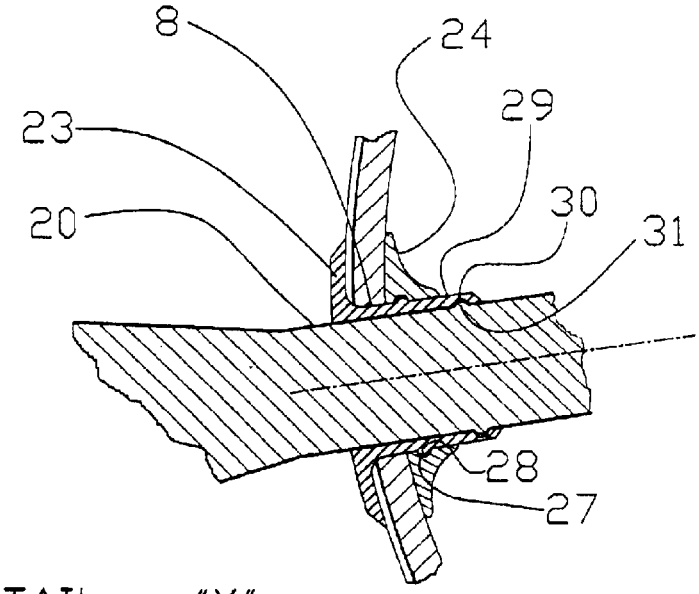
Figure 4:
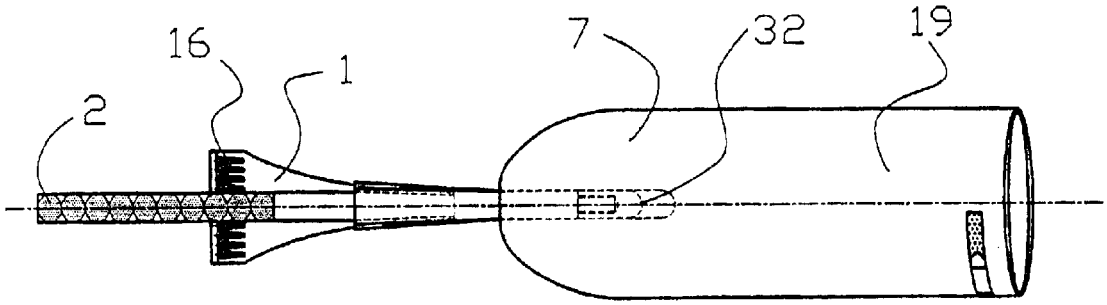
FIG. 4 is a top view of the ice scraper and brush with the glove and the gun barrel shaped handle of FIG. 3.

FIG. 3 and FIG. 4 are analogous to FIG. 1 and FIG. 2 with the exception that the ice scraper and brush with the glove is designed with gun barrel like handle grip 32, which allows heavy duty scraping operations as well as the comfortable and firm grip. This provides a more concentrated scraping force.

Figure 5:
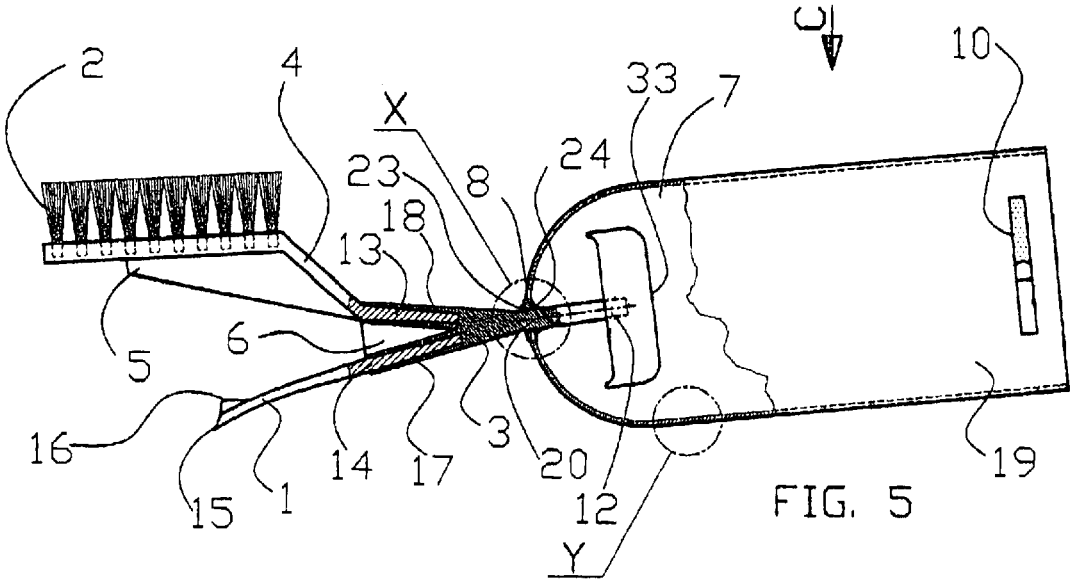
FIG. 5 is a plane view of the ice scraper and brush with the glove and the T-shaped handle grip.
Figure 5A:
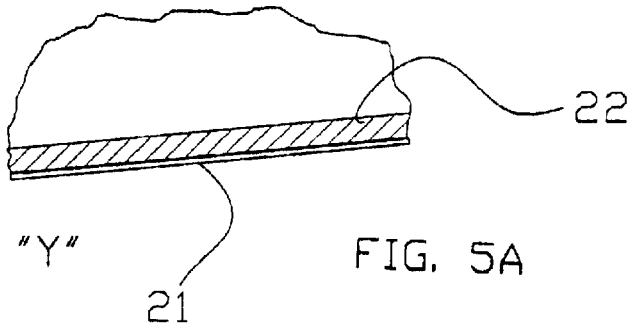
Figure 5B:
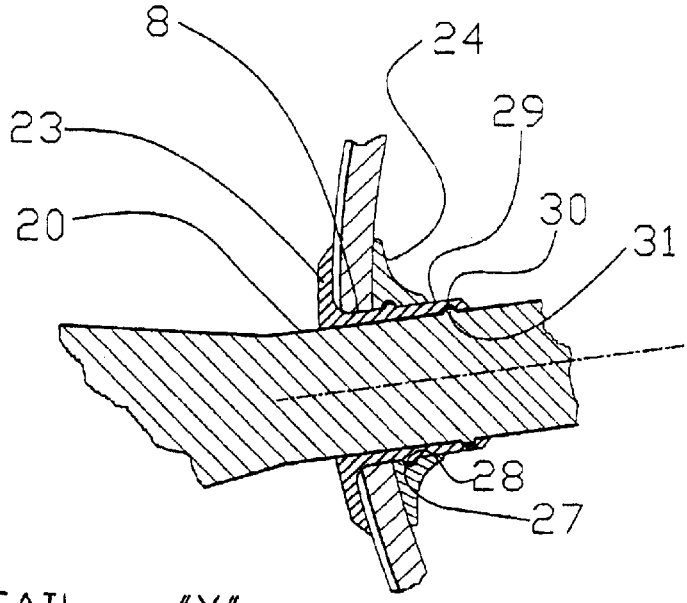
Figure 6:
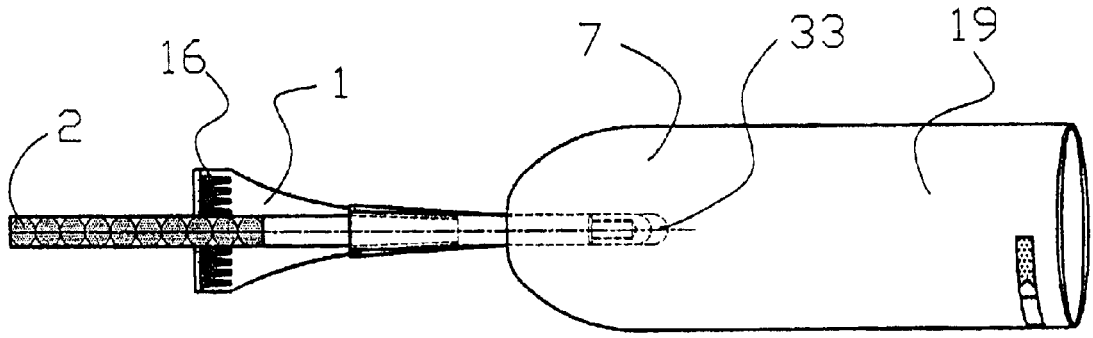
FIG. 6 is a top view of the ice scraper and brush with the glove and the T-shaped handle grip of FIG.5.

FIG. 5 and FIG. 6 are analogous to FIG. 1 and FIG. 2 with the exception that the ice scraper and brush with the glove is designed with the T-shaped handle grip 33. As previously described gun barrel like handle grip 32, this one has similar advantages including heavy duty scraping operations as well as the comfortable and firm grip.

Figure 7:
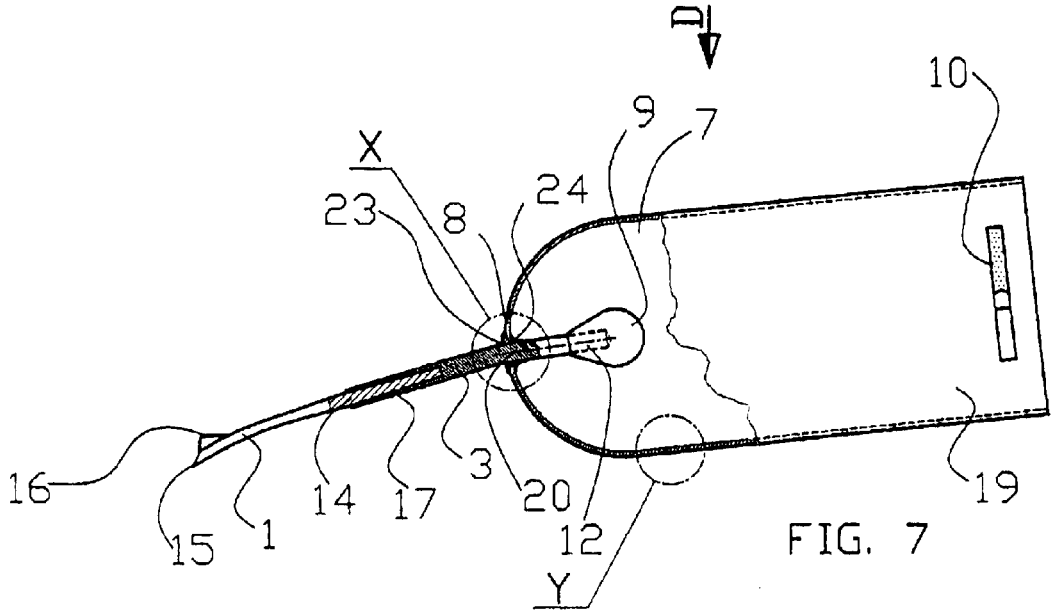
FIG. 7 is a plane view of the ice scraper with the glove and the spherically shaped handle grip.
Figure 7A:
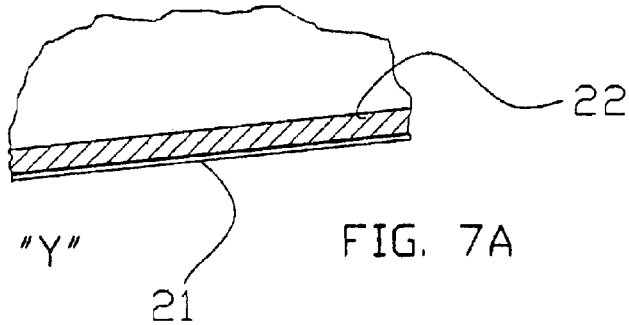
Figure 7B:
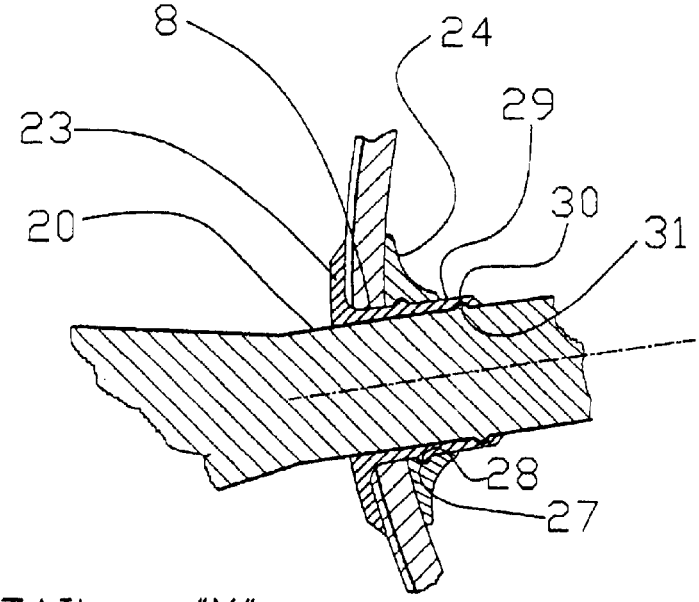
Figure 8:
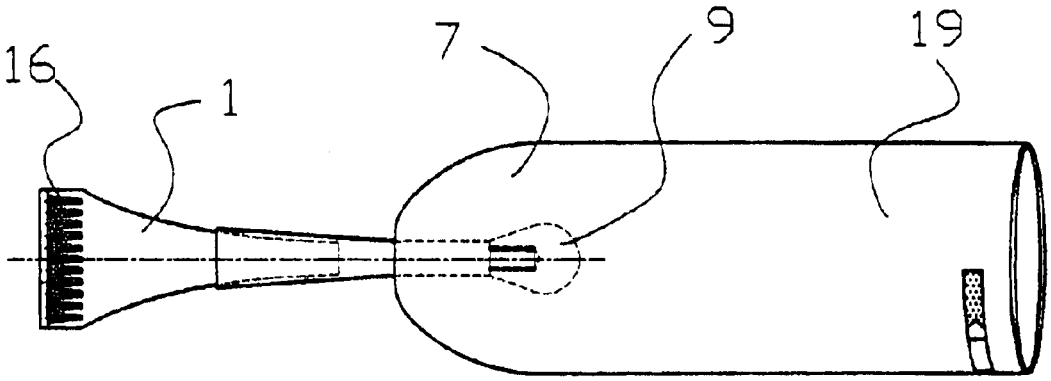
FIG. 8 is a top view of the ice scraper with the glove and the spherically shaped handle grip.

FIG. 7 and FIG. 8 are similar in form and function, but without a brush 2. They consist out of exchangeable scraper blade 1, which fits into cavity 34 in handle body 35. This was previously described in FIG. 1 and FIG. 2.

Figure 9:
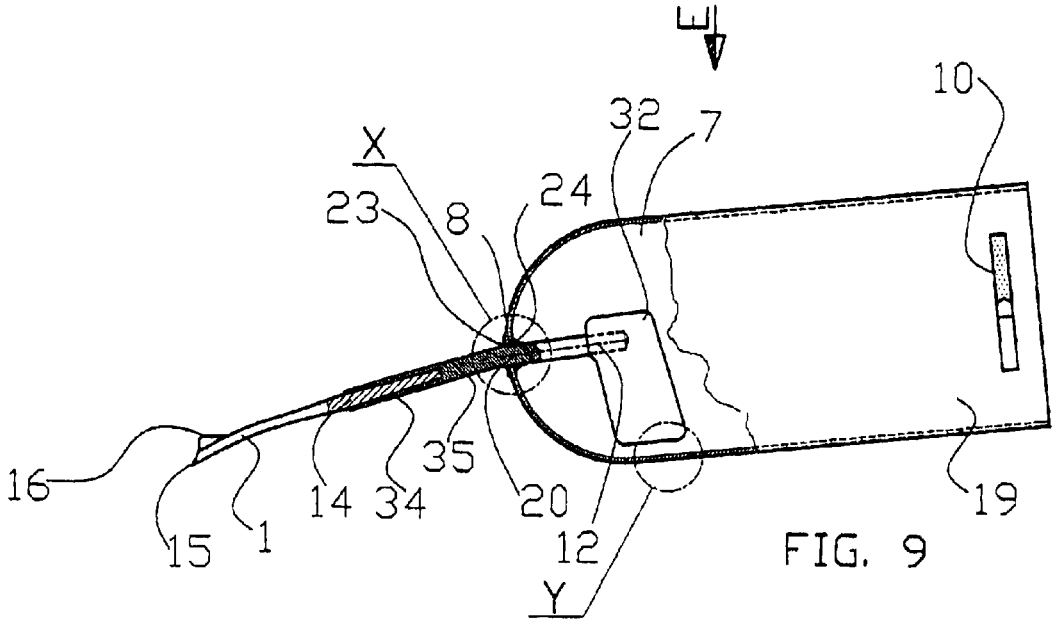
FIG. 9 is a plan view of the ice scraper with the glove and the gun barrel like handle grip.
Figure 9A:
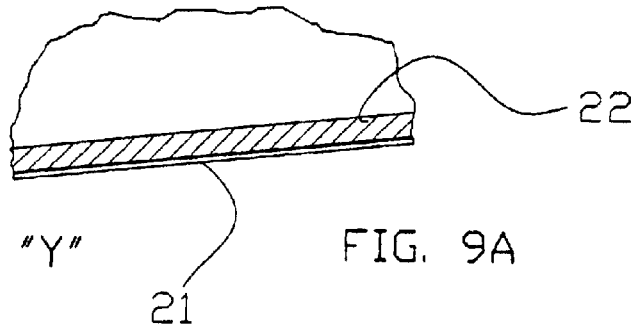
Figure 9B:
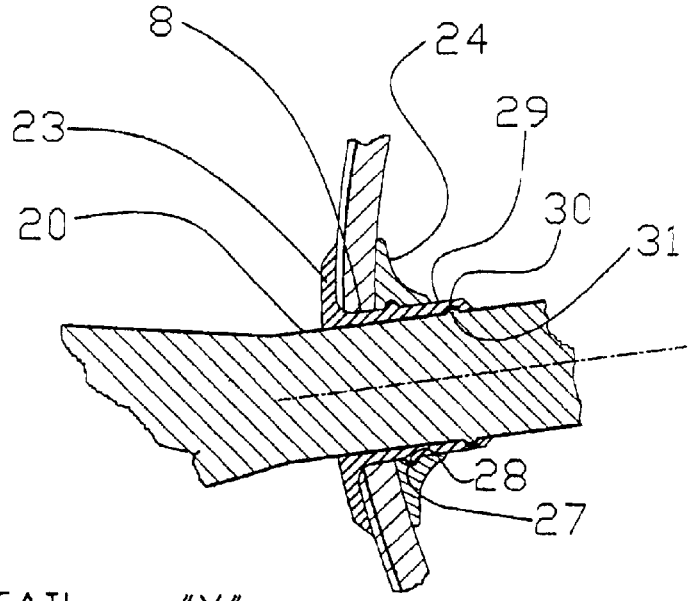
Figure 10:
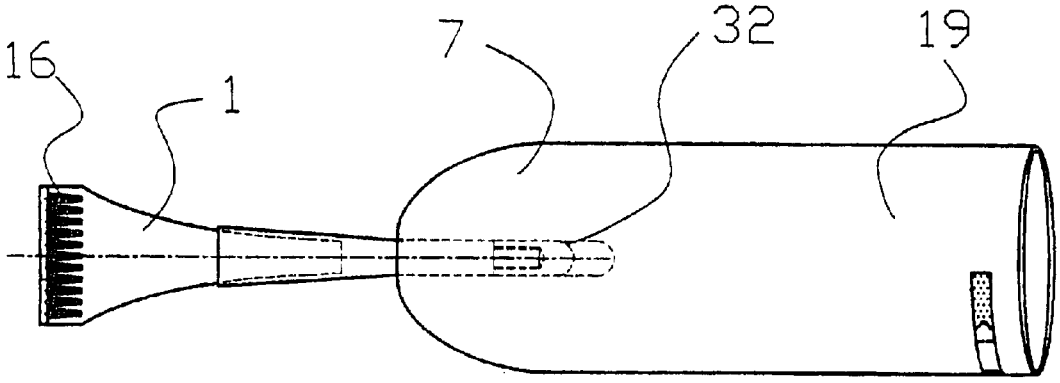
FIG. 10 is a top view of the ice scraper with the glove and the gun barrel like handle grip.

FIG. 9 and FIG. 10 are analogous to FIG. 7 and FIG. 8 with the exception that the ice scraper with glove is designed with the gun barrel like handle grip 32, which screws, onto the end portion of the handle 12.

Figure 11:
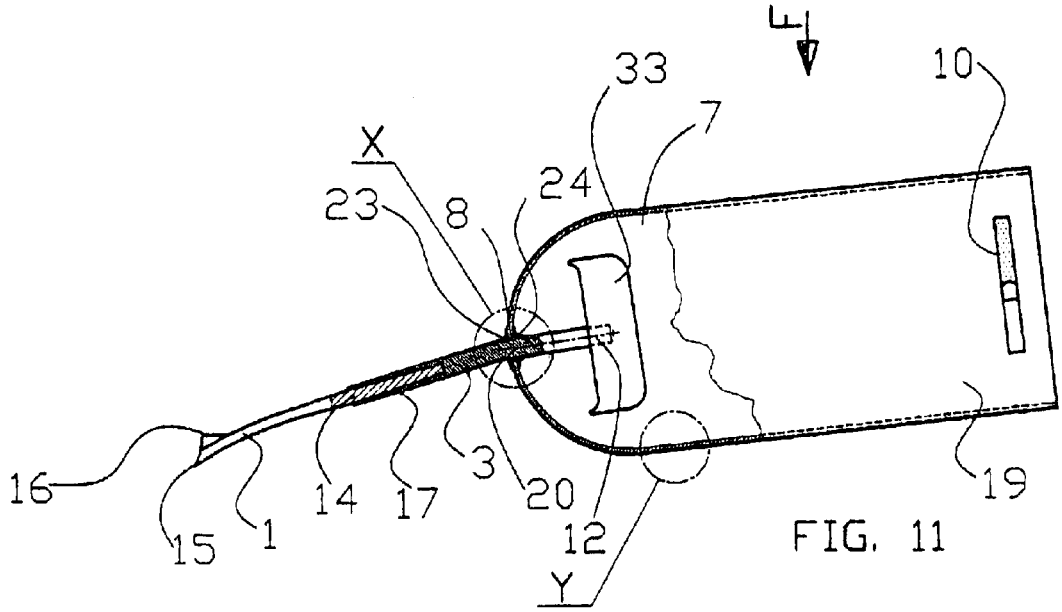
FIG. 11 is a plan view of the ice scraper with the glove and the T-shaped handle grip.
Figure 11A:
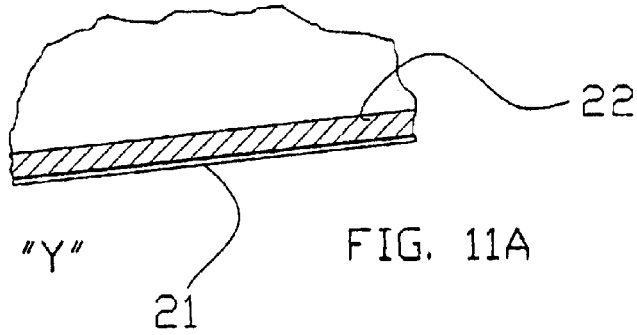
Figure 11B:
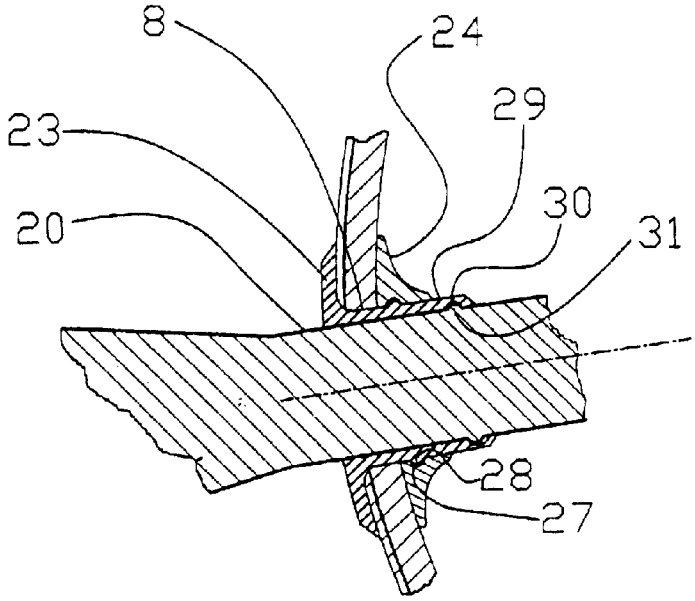
Figure 12:
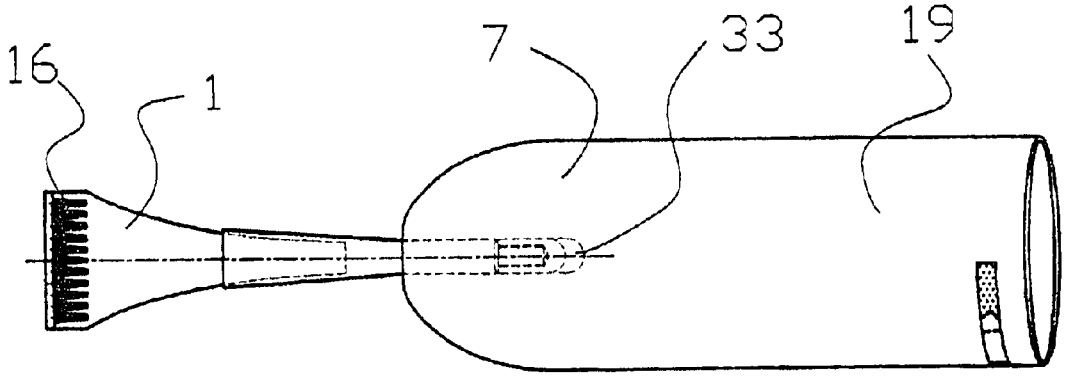
FIG. 12 is a top view of the ice scraper with the glove and the T-shaped handle grip.

FIG. 11 and FIG. 12 are analogous to FIG. 7 and FIG. 8 with exception that the ice scraper with the glove is designed with the T-shaped handle grip 33, which is screws onto the end portion of the handle 12.

Figure 1A:
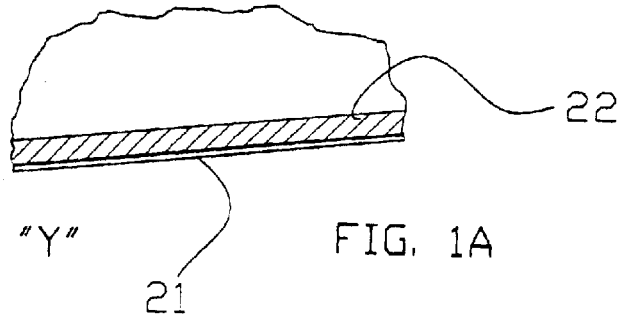
FIGS. 1A, 3A, 5A,7A,9A,11A all show detail Y, which represents the partial cross-section of the glove.

FIG. 1A shows a detail of an outside portion of the glove's surface 21 that is made out of water proof material to protect the inside of the glove 22, which can be mad out of any thermo-insulating fabric.

Figure 1B:
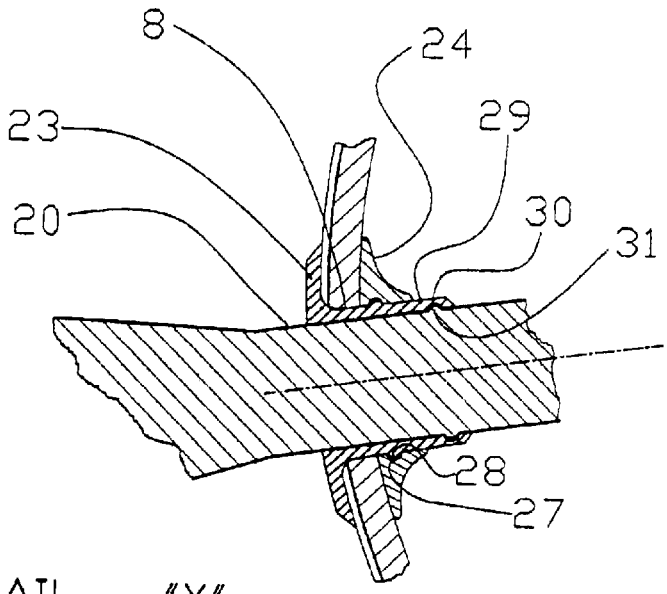
FIGS. 1B,3B,5B,7B,9B,11B all show detail X, which represents the cross-section of the handle neck sealing at the top of the glove.

FIG. 1B illustrates the sealing between the handle neck 20 and the slit 8 on the top of the glove 7. The outside plate member 23 is disposed on the top of the glove 7 to cover the slit 8. In addition, the outside plate member 23 has an extended body 29 with the small circumferential inside grove 30. This fits onto the plate extension body 29 that is connected and secured with the handle neck 20 using clutch tooth member, 30. Inside plate 24 has circumferential inside grove 27, which fits onto the plate extension body 29 that is connected and secured using clutch tooth member 28.

What is claimed is:

1. An ice scraper and brush with a glove comprising:

a) an exchangeable scraper blade and brush that are inserted into a fork branched, anatomically designed handle grip;

b) the handle grip which is inserted into the exchangeable scraper blade and brush is installed into a glove with an extended sleeve;

c) a curved fork branched handle grip;

d) a gusset that is attached to the fork branched handle grip;

e) the brush is firmly mounted to a portion of the fork branched handle grip with a conical interference fit;

f) sealing plates that are attached to the fork branched handle grip and have an outside plate member that has an extended body with a small circumferential inside groove, which fits onto the plate extended body and is connected and secured with a clutch tooth member;

g) the glove's external side is made out of waterproof fabric and the internal side is made out of thermo-insulating fabric, having one slit at the top, to allow the installation of the handle to the fork branched handle grip of the ice scraper and brush, the glove also has velcro fasteners at the sleeve portion of the glove.

2. The apparatus from claim 1 wherein said ice scraper and brush with the glove is designed with a spherical handle grip.

3. The apparatus from claim 1 wherein said ice scraper and brush with the glove is designed with a gun barrel like handle grip.

4. The apparatus from claim 1 wherein said ice scraper and brush with the glove is designed with an anatomically designed T-shaped handle grip.

5. An ice scraper and brush with a glove comprising:

a) an exchangeable scraper blade and brush that are inserted into a fork branched, anatomically designed handle grip;

b) the handle grip which is inserted into the exchangeable scraper blade and brush is installed into a glove with an extended sleeve;

c) a curved fork branched handle grip;

d) a gusset that is attached to the fork branched handle grip;

e) the brush is firmly mounted to a portion of the fork branched handle grip with a conical interference fit;

f) the glove's external side is made out of waterproof fabric and the internal side is made out of thermo-insulating fabric, having one slit at the top, to allow the installation of the handle to the fork branched handle grip of the ice scraper and brush, the glove also has velcro fasteners at the sleeve portion of the glove.

* * * * *